US010443223B2

(12) United States Patent
Kashirajima et al.

(10) Patent No.: US 10,443,223 B2
(45) Date of Patent: Oct. 15, 2019

(54) FLUSH TOILET

(71) Applicant: TOTO LTD., Kitakyushu-shi, Fukuoka (JP)

(72) Inventors: Shu Kashirajima, Kitakyushu (JP); Masaaki Momoe, Kitakyushu (JP); Yuuki Shinohara, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 15/808,394

(22) Filed: Nov. 9, 2017

(65) Prior Publication Data

US 2018/0135291 A1 May 17, 2018

(30) Foreign Application Priority Data

Nov. 16, 2016 (JP) ..... 2016-223230

(51) Int. Cl.
*E03D 11/08* (2006.01)

(52) U.S. Cl.
CPC ..... *E03D 11/08* (2013.01)

(58) Field of Classification Search
CPC ..... E03D 11/02; E03D 11/06; E03D 11/08; E03D 11/13
USPC ..... 4/420, 421, 425, 430, 429, 440, 329
See application file for complete search history.

(56) References Cited

U.S. PATENT DOCUMENTS 4,918,763 A * 4/1990 Brotcke ..... E03D 1/286 4/331
6,145,138 A * 11/2000 Nakamura ..... E03D 11/02 4/420
7,325,258 B2 * 2/2008 Asada ..... E03D 11/08 4/363
2006/0005310 A1 * 1/2006 Nakamura ..... E03D 11/08 4/420
2007/0061955 A1 * 3/2007 Asada ..... E03D 11/08 4/425
2013/0047330 A1 * 2/2013 Yamasaki ..... E03D 11/13 4/431
2014/0289947 A1 * 10/2014 Hirakawa ..... E03D 11/08 4/421

FOREIGN PATENT DOCUMENTS

JP 2014-034868 A 2/2014
JP 2015-168994 A 9/2015

* cited by examiner

*Primary Examiner* — Erin Deery
(74) *Attorney, Agent, or Firm* — Studebaker & Brackett PC

(57) ABSTRACT

A flush toilet includes a body including a body inner wall forming the majority of the bowl surface of a bowl and a connecting portion connecting this outside wall and body inner wall; a rim including a rim inner wall forming a portion of the bowl surface, joined to the top end of the body; and a rim spout portion spouting flush water into the bowl. This rim spout portion respectively forms a rim conduit formed by joining a body and a rim, and a rim spout port; the joining surface between the body inner wall forming the rim conduit and the rim inner wall is set to a lower position from the rear side of the bowl toward the front; and the bottom surface of the rim conduit is set to a lower position from the upstream end toward the downstream end of the rim conduit.

4 Claims, 12 Drawing Sheets

FLUSH TOILET

TECHNICAL FIELD

The present invention relates to a flush toilet, and more particularly to flush toilet configured to discharge waste by flushing the flush toilet with flush water supplied from a flush water source.

BACKGROUND

For some time, known toilets in which the toilet is flushed by flush water supplied from a flush water source to discharge waste have included, front elevation, those such as that set forth in Patent Document 1 (Japanese Patent Unexamined Publication No. 2014-34868), in which the adhesion surface between a body inner wall forming the majority of a bowl surface and a rim inner wall forming a portion of the bowl surface rises from the center region toward the front side region in the front-rear direction, and a rim conduit is formed on the upstream side of a rim spout port by adhesion of the body to the rim.

Also, as set forth in Patent Document 2 (Japanese Patent Unexamined Publication No. 2015-168994), flush toilets are known in which, for each of the conduits respectively formed on the upstream side of the two rim spout ports spouting flush water into the bowl, the bottom surface of the inlets thereof is positioned below the bottom surface of the outlet portion thereof.

However, in the above-described conventional flush toilet set forth in Patent Documents 1 and 2, water remaining in the rim conduit after completion of flush water spouting from the rim spout port is discharged from the rim spout port. However, because the time until this residual water stops is relatively long, there is a risk that a user viewing the residual water during discharge would mistake it for a leak. A further problem is that discharged residual water may remain on the bowl surface, or that residual water which has not been fully discharged may remain in the rim conduit.

In addition, with the diversification of flush toilet designs in recent years, there has been a growing need to plan for visual simplicity in the appearance of the toilet main unit bowl interior or the rim inside perimeter side, by placing items such as the rim spout port or the rim conduit relative to the rim so that the rim spout port or the upstream side rim conduit is invisible to the user side, and to design so that water is spouted rearward from the rim spout port. In such a form, where water is spouted rearward from a rim spout port, the rim conduit is formed in a limited space within the rim. The length of the flow path to obtain a flush water flow volume in the rim conduit is therefore set to be relatively long, and the size of the rim spout port to obtain a sufficient flush water flow speed (especially the rim spout port height dimension) is set to be relatively small.

Therefore in such a spouting form, in which water is spouted rearward from a rim spout port, the problem arises that the time until residual water stops lengthens as the flow path length used to achieve a specified flow volume in the rim conduit increases. Another problem is that the shorter the rim spout port height dimension used to obtain sufficient flush water flow speed, the more difficult it becomes to provide countermeasures to residual water, such as sloping the bottom surface of the rim conduit.

An issue has thus been how to increase the discharge force used to discharge residual water in the rim conduit from the rim spout port.

SUMMARY

The present invention was undertaken to solve the above-described problems with the conventional art, and has the object of providing a flush toilet capable of increasing the discharge force used to discharge residual water in the rim conduit from the rim spout port.

To solve the above-described problems, the present invention provides a flush toilet configured to discharge waste by flushing the flush toilet with flush water supplied from a flush water source. The flush toilet comprises a body which includes a body inner wall forming a majority of a bowl surface, an outer wall forming an externally seen surface, and a connecting portion connecting the outer wall and the body inner wall. The flush toilet also comprises a rim which includes a rim inner wall forming a part of the bowl surface, the rim being joined to a top end of the body. The flush toilet also comprises a bowl which forms the bowl surface joining the body inner wall and the rim inner wall. The flush toilet also comprises a rim spout portion disposed on the bowl, the rim spout portion configured to spout the flush water inside the bowl. The rim spout portion includes a rim conduit and a rim spout port. The rim conduit is formed by joining of the body and the rim and is configured to supply with the flush water from the flush water source. The rim spout port is at a downstream end of the rim conduit. A joining surface in a front side of the bowl between the body inner wall and the rim inner wall forming the rim conduit is positioned lower than the joining surface in a rear side of the bowl. A bottom surface in a downstream region of the rim conduit formed by the connecting portion of the body is positioned lower than a bottom surface in an upstream region of the rim conduit.

According to the invention thus constituted, the mutual joining surface between the body inner wall forming the rim conduit and the rim inner wall is positioned lower from the rear side toward the front side of the bowl, and the bottom surface of the rim conduit formed by the body connecting portion is positioned lower from the upstream end to the downstream end of the rim conduit, therefore the overall bottom surface of the rim conduit can be sloped greatly downward along the flow path from the upstream end to the downstream end of the rim conduit.

The discharge force by which residual water in the rim conduit is discharged from the rim spout port can thus be increased.

In the present invention, preferably, the bowl includes a front side region and a rear side region. The front side region is formed on a front side of a center axis extending horizontally in a left-right direction of the bowl so as to divide the bowl equally in a front-rear direction of the bowl. The rear side region is formed on a rear side of the center axis. The rim conduit and the rim spout port are formed on the rim disposed on either a left or right of the front side region of the bowl. The rim conduit includes an inlet, an outside rim conduit, a bent rim conduit, and an inside rim conduit. The outside rim conduit is configured to extend forward from the inlet through an interior of the rim. The bent rim conduit is configured to bend to an inside from a downstream end of the outside rim conduit. The inside rim conduit is configured to extend rearward from the bent rim conduit up to the rim spout port. The bottom surface of the rim conduit is positioned lower from the inlet through the outside rim conduit, the bent rim conduit and the inside rim conduit, toward the rim spout port.

According to the invention thus constituted, the rim conduit and the rim spout port are formed on a rim placed on either the left or right of the front area of the bowl, and the rim conduit includes an external rim conduit extending from the inlet of the rim conduit toward the front through the interior of the rim, a bent rim conduit bending from the downstream end of this outside rim conduit to the inside, and an inside rim conduit extending from this bent rim conduit rearward up to the rim spout port, such that even if the rim conduit can be relatively easily lengthened, the rim conduit bottom surface is positioned lower from the rim conduit inlet through the outside rim conduit, the bent rim conduit, and the inside rim conduit toward the rim spout port, therefore the overall bottom surface of the rim conduit can be sloped greatly downward along the flow path from the upstream end to the downstream end of the rim conduit.

Residual water in the rim conduit can therefore be reliably discharged from the rim spout port.

In the present invention, preferably, a bottom surface of the inside rim conduit is sloped downward toward an inside of the bowl.

According to the invention thus constituted, the bottom surface of the rim conduit is sloped downward toward the inside of the bowl in the inside rim conduit section after bending in the bent rim conduit of the rim conduit, therefore discharge from the rim spout port can be efficiently and reliably accomplished while directing residual water in the rim conduit along the sloped surface to the inside of the bowl.

In the present invention, preferably, the flush water source supplying flush water to the rim conduit is configured to supply the flush water by using water utility supply pressure.

According to the invention thus constituted, the flush water supply supplying flush water to the rim conduit supplies flush water using water utility supply pressure, such that the flush water flow volume in the rim conduit is relatively small, and the flush water source supply pressure tends to exert an effect, therefore the rim spout port height dimension is set to be relatively small in order to assure sufficient flush water flow speed in the rim conduit.

Hence the discharge force on residual water in the rim spout port can also be increased.

With the flush toilet of the present invention, the discharge force by which residual water in the rim conduit is discharged from the rim spout port can be increased.

DETAILED DESCRIPTION

Next, referring to FIGS. 1-12, a flush toilet according to one embodiment of the invention is explained hereafter.

Figure 1:
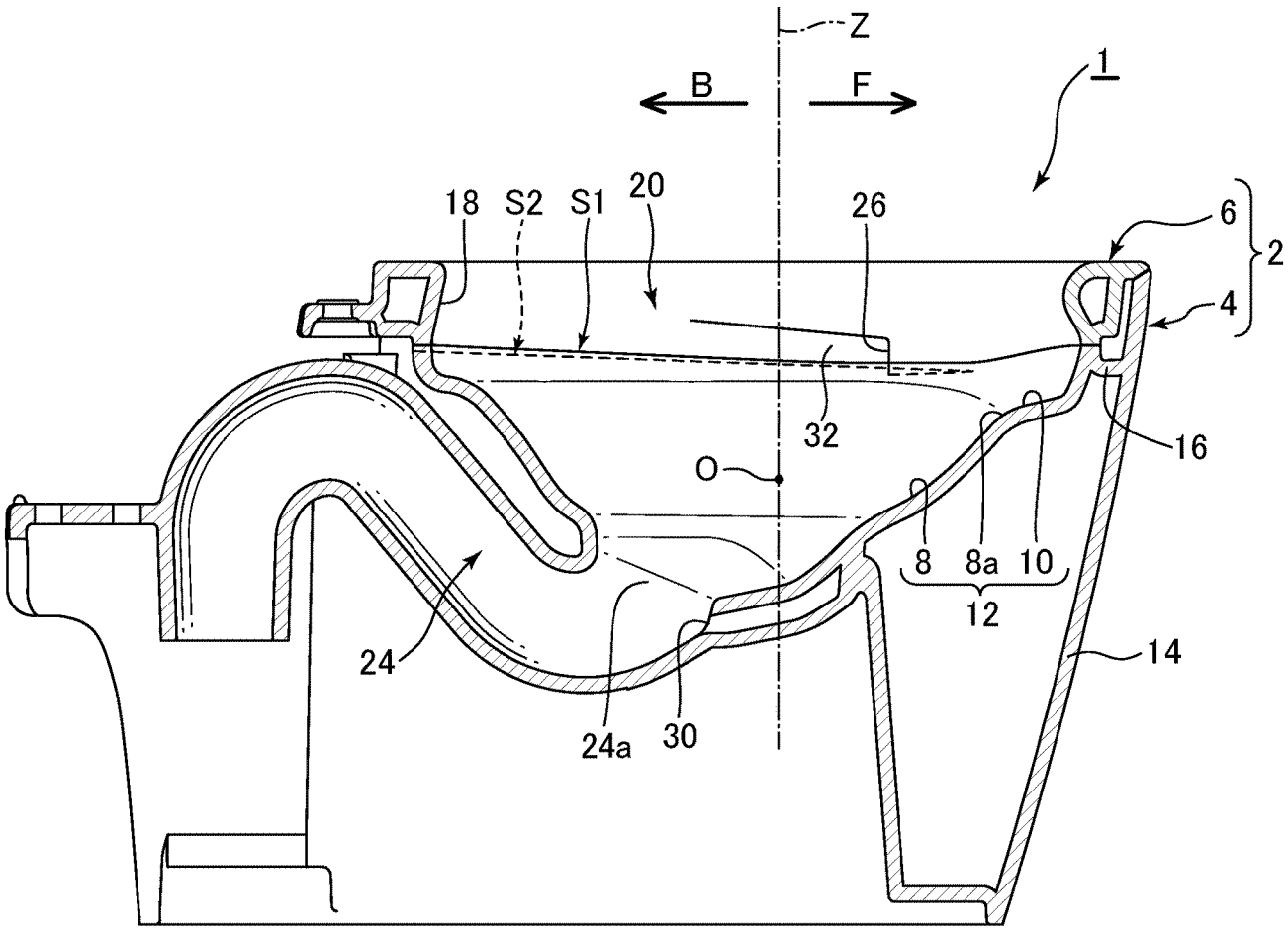
FIG. 1 is a center side elevation cross section of a flush toilet main unit of a flush toilet according to one embodiment of the invention.
Figure 2:
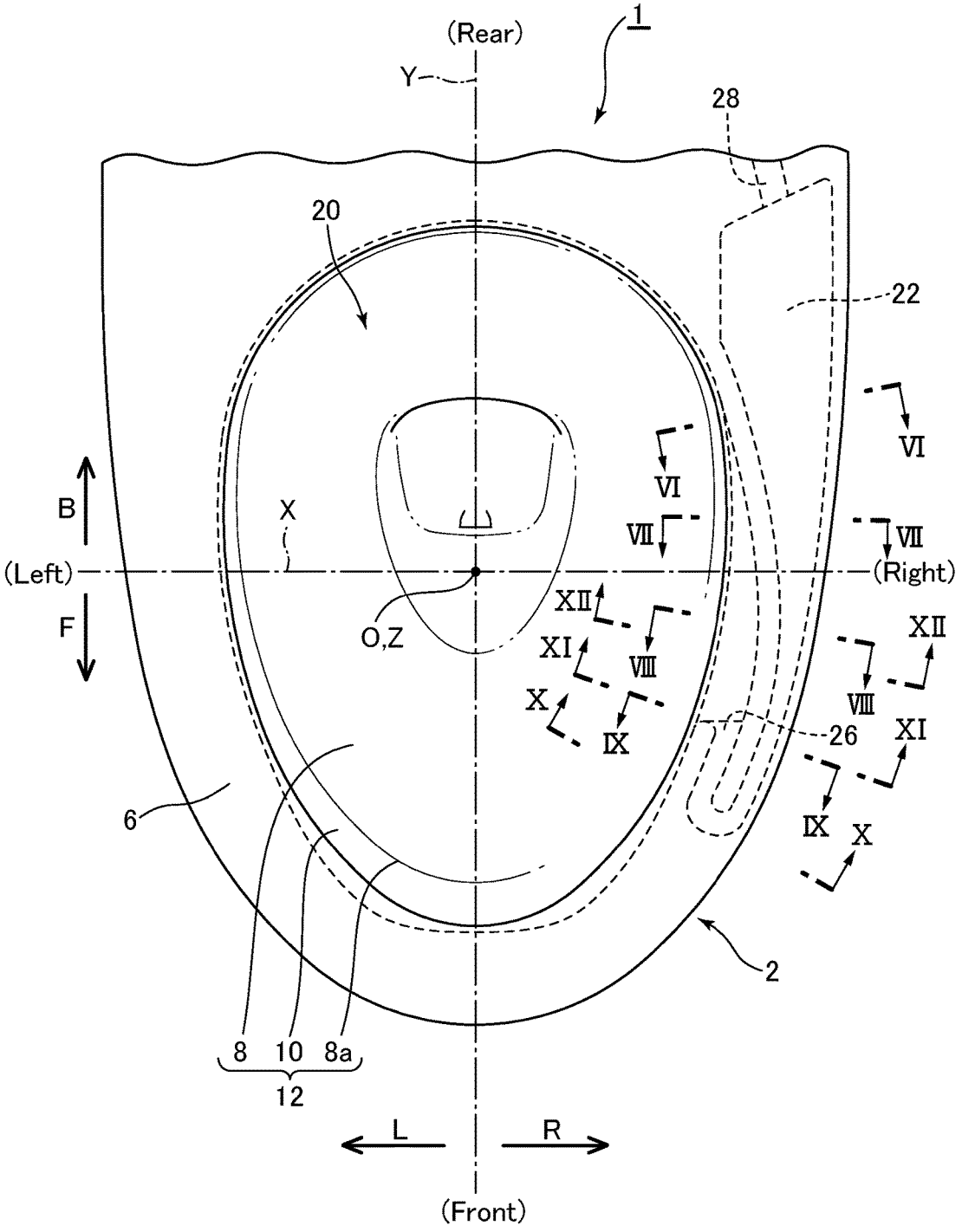
FIG. 2 is a plan view of the flush toilet main unit of the flush toilet according to the one embodiment of the invention.

First, FIG. 1 is a center side elevation cross section of the flush toilet main unit of the flush toilet according to an embodiment of the invention. FIG. 2 is a plan view of the flush toilet main unit of the flush toilet according to the one embodiment of the invention. In addition, FIG. 3 is an exploded view of the flush toilet main unit of the flush toilet according to the one embodiment of the invention.

Figure 3:
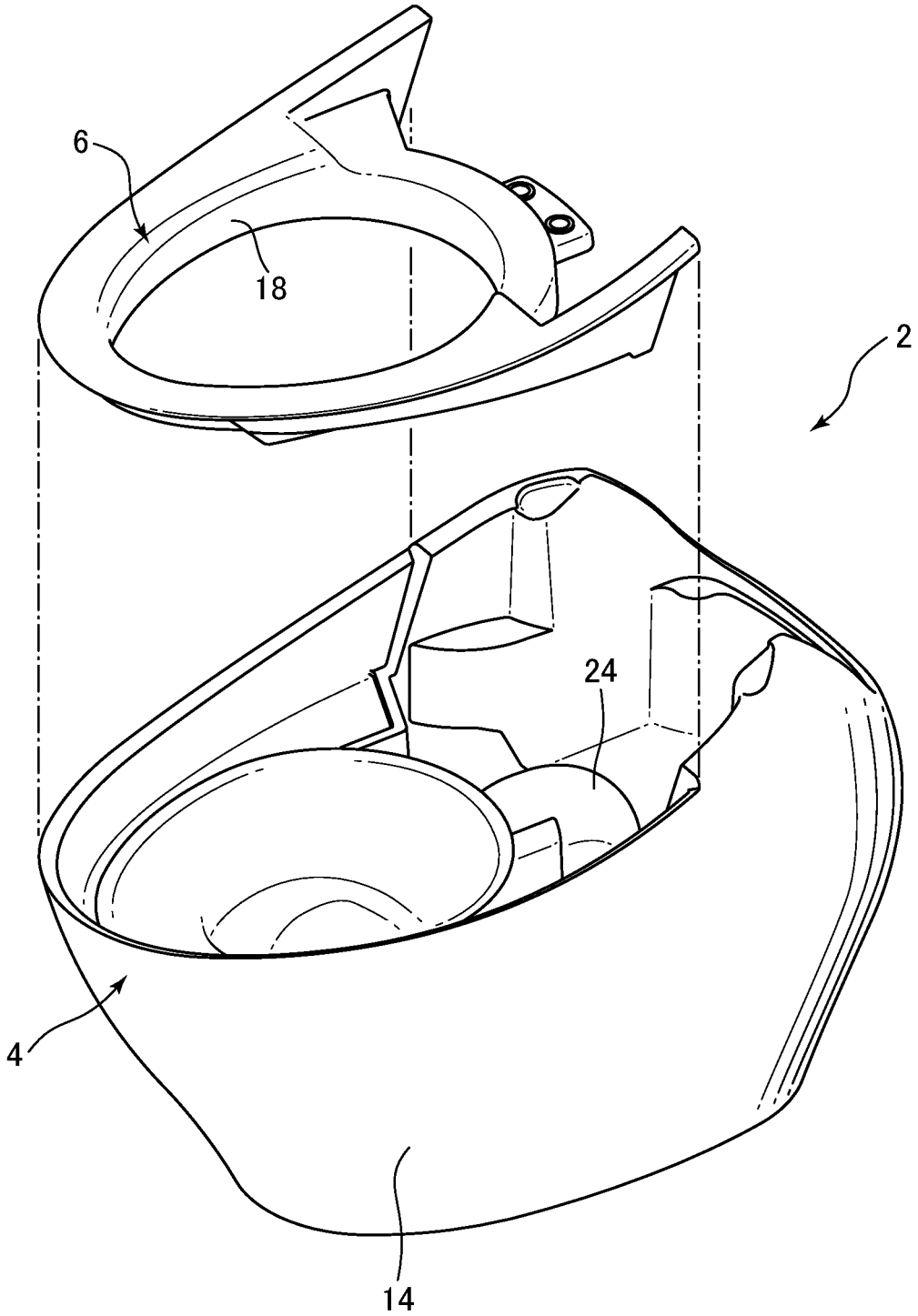
FIG. 3 is an exploded perspective view of the flush toilet main unit of the flush toilet according to the one embodiment of the invention.

As shown in FIGS. 1-3, the flush toilet 1 according to the one embodiment of the invention includes a toilet body 2 made of ceramic. The toilet main unit 2 is made up of a body 4 and a rim 6 joined to the top end of this body 4.

The flush toilet 1 of the embodiment shown in FIGS. 1 and 2 has a toilet seat and lid (not shown) disposed on the top surface of the toilet main unit 2. A sanitary flush device for washing a user's private parts, and other functional devices, such as a water supply system that functions to supply water to the toilet main unit 2, are installed on the rear side of the toilet seat and toilet lid. Please note that these devices are not illustrated in the drawings, and an explanation thereof is omitted.

Next, as shown in FIGS. 1-3, the body 4 of the toilet main unit 2 includes a body inner wall which forms half or more (the majority) of the bowl surface on its interior. This body inner wall forms a waste receiving surface 8, and includes an inner wall 12 forming a shelf surface 10 on the outside of the top edge 8*a* of this waste receiving surface 8.

As shown in FIGS. 1 and 3, the body 4 includes an outside wall 14 forming its externally seen surface, and a connecting portion 16 connecting this outside wall 14 and the inner wall 12. The inner wall 12, outside wall 14, and connecting portion 16 of the body 4 are thus integrally formed with one another.

Next, as shown in FIGS. 1-3, the rim 6 of the toilet main unit 2 includes an inner wall (rim inner wall) 18 forming a rim inner wall surface, which is part of the bowl surface.

A bowl 20 is formed when the bottom end of the inner wall 18 of the rim 6 is joined to the top end of the inner wall 12 of the body 4. The bowl surface is formed on the interior of the toilet main unit 2 by this bowl 20.

In addition, we discuss below further details of the joining portion between the body 4 and the rim 6. As shown in FIGS. 1-3, when the bottom end of the inner wall 18 of the rim 6 is joined to the top end of the inner wall 12 of the body 4 and the outside edge of the rim 6 is joined to the top end of the body 4 outside wall 14, a rim conduit 22 is formed (described in detail below), functioning as a part of the rim spout portion for spouting flush water into the bowl 20.

As shown in FIGS. 1 and 3, the body 4 of the toilet main unit 2 includes a discharge trap pipe 24. On the discharge trap pipe 24, an inlet 24*a* is connected to the bottom of the bowl 20, and the discharge trap pipe 24 serves as a discharge path for discharging waste into the bowl 20.

In the plan view of the bowl 20 of the toilet main unit 2, the flush toilet 1 according to the one embodiment of the invention shown in FIGS. 1 and 2 has a center axis identified by the letter "X" that extends horizontally in the left-right direction and equally divides the bowl 20 into front and rear parts. Also, the flush toilet 1 has a center axis identified by the letter "Y" that extends horizontally in the front-rear direction and equally divides the bowl 20 into left and right parts. In addition, the flush toilet 1 has a center axis identified by the letter "Z" that extends vertically and passes through a center O of the bowl 20.

Further, as shown in FIG. 2, the front, rear, left, and right directions of the flush toilet 1 are respectively identified by the legends "front," "rear," "left," and "right."

And, as shown in FIGS. 1 and 2, the legends "front side region F" and "rear side region B" define the front and rear sides of the flush toilet 1, respectively, with respect to the center O, the center axis X extending horizontally in the left-right direction, and the center axis Z extending vertically of the bowl 20 of the flush toilet 1.

In addition, as shown in FIG. 2, the legends "left side region L" and "right side region R" define for the left and right sides of the flush toilet 1, respectively, as seen from the front, with respect to the center O and the center axis Y extending horizontally in the front-rear direction of the bowl 20 of the flush toilet 1.

As shown in FIGS. 1 and 2, with the body 4 and the rim 6 in a joined state, a rim conduit 22 that performs as a part of the functionality of the rim spout portion is formed on inside of the right side region R and the front side region F of the bowl 20.

A single rim spout port 26 is formed on the downstream side of the rim conduit 22. The rim spout port 26 performs as a part of the functionality of the rim spout portion by spouting flush water rearward into the bowl 20 to form a circulating flow.

That is, the rim spout portion comprises the single rim spout port 26 disposed in the rim 6 of the bowl 20 for spouting flush water throughout the entire circumference of the rim 6. The rim spout port 26 is disposed on the rim 6 in the right side region R and in the front side region F of the bowl 20 and spouts flush water rearward.

Also, as shown in FIG. 2, the upstream side of the rim conduit 22 is directly connected to a water conducting pipe 28. The upstream side of this water conducting pipe 28 is directly connected to a utility water pipe (not shown), being the flush water source. With the piping configuration, the water supply pressure is thereby utilized so that flush water supplied into the rim conduit 22 from the water conducting pipe 28 is directed forward within the rim conduit 22, and then guided inside and rearward over to the rim spout port 26 located downstream.

Flush water directed to the rim spout port 26 is spouted (rim spouted) toward rearward and circulated inside the bowl 20, thereby forming a circulating flow inside the bowl 20.

The flush toilet 1 of the present embodiment has been described, in which the rim conduit 22 is disposed inside the rim 6 in the right side region R of the bowl 20, and the single rim spout port 26 is opened in the inner periphery of the rim 6 of the front side region F and the right side region R of the bowl 20. However, it is to be noted that the present invention is not limited to the described embodiment, and other variations can be adopted in which the rim conduit 22 is disposed inside the rim 6 in the left side region L of the bowl 20, and the single rim spout port 26 is opened in the inner periphery of the rim 6 in the front side region F and left side region L of the bowl 20 so as to perform spouting (rim spouting) rearward from the rim spout port 26.

Also, as shown in FIG. 1, a jet spout port 30 is formed at the bottom portion of the bowl 20. The jet spout port 30 is directed at the inlet 24*a* of the discharge trap pipe 24. With the configuration, spouting (jet spouting) from the water supply functional portion (not shown) is also effected from the jet spout port 30.

Note that in the flush toilet 1 according to the present embodiment, rim spouting by the rim spout port 26 is performed using the water supply pressure. Alternatively, a "hybrid" form of flush toilet may be adopted in which a pressurizing pump (not shown) for jet spouting by the jet spout port 30 is used to supply flush water from a reservoir tank (not shown). It should be noted, however, that the invention is not limited to these configurations and other variations may also be adopted. For example, jet spouting by the jet spout port 30 may be dispensed with.

Next, referring to FIGS. 1-12, details of a rim spout portion in a flush toilet 1 according to the one embodiment of the invention, and details of the joining portion between the body 4 and the rim 6 are explained as follows.

Figure 4:
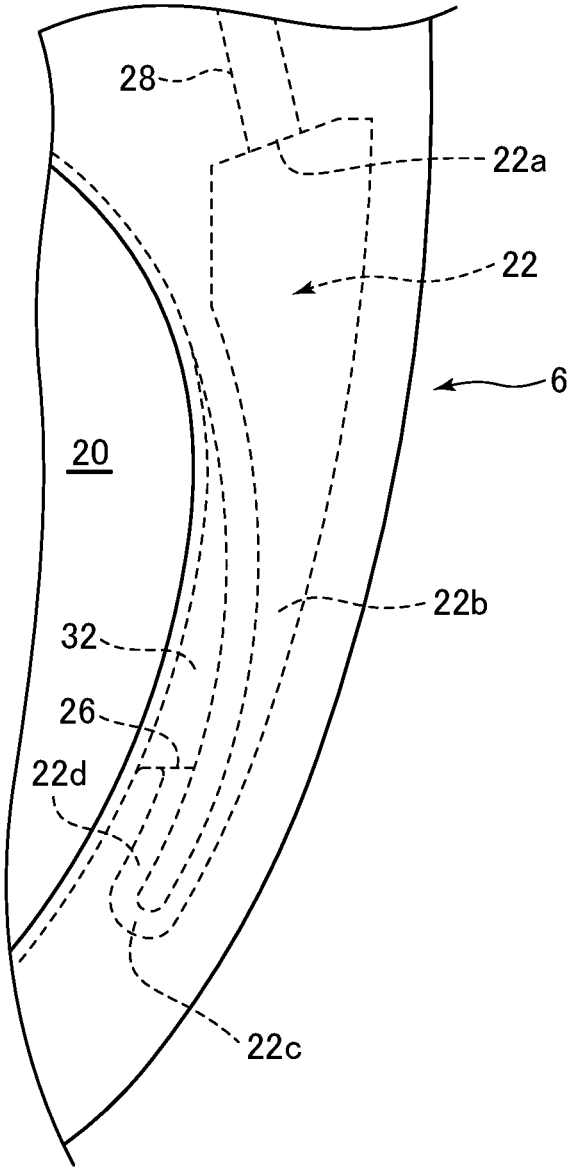
FIG. 4 is a partial expanded plan view of a rim conduit part formed in the rim interior, in the flush toilet main unit of a flush toilet according to the one embodiment of the invention shown in FIG. 2.
Figure 5:
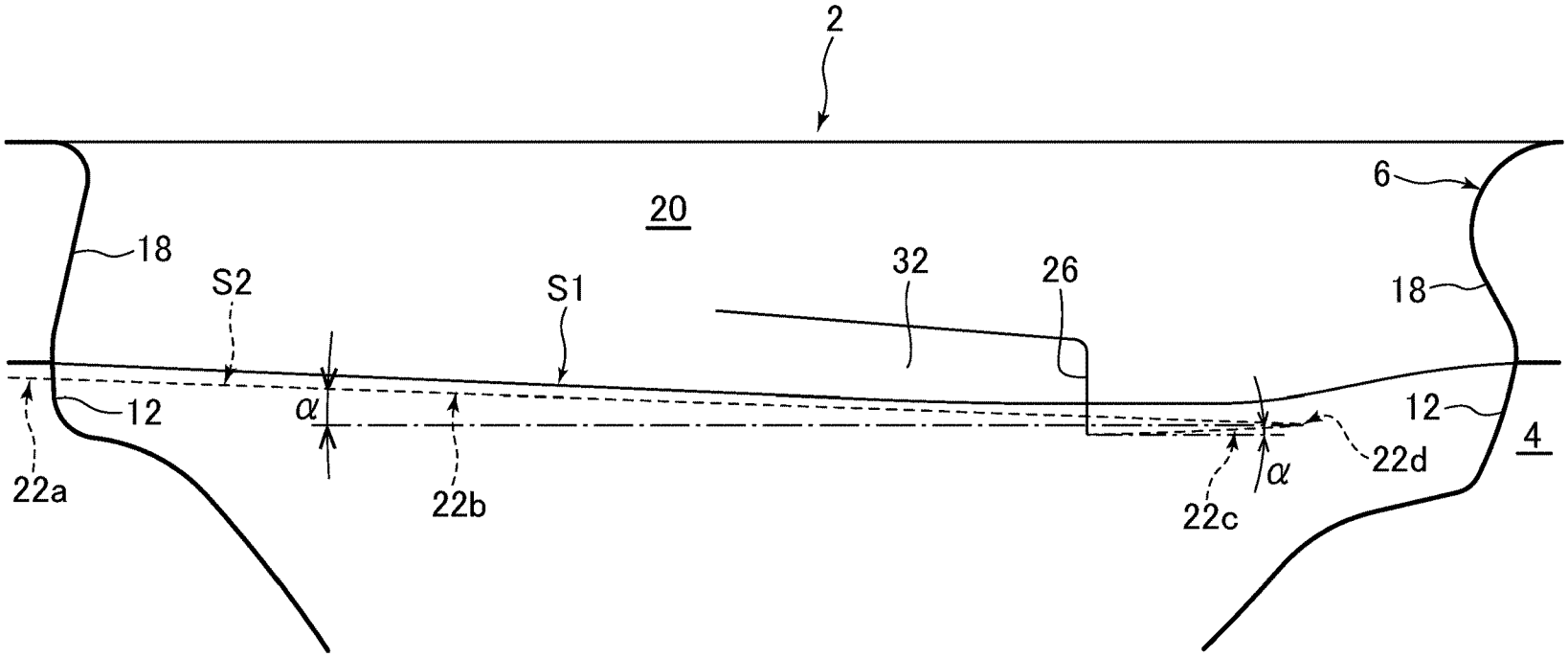
FIG. 5 is a schematic diagram showing in summary form the joining surface between the body and the rim, and the slope of the rim conduit path, in the toilet main unit of the flush toilet according to the one embodiment of the invention.

First, FIG. 4 is a partial expanded plan view of a rim conduit part formed in the rim interior, in the flush toilet main unit of a flush toilet according to the embodiment of the invention shown in FIG. 2. FIG. 5 is a schematic diagram showing in summary form the joining surface between the body and the rim, and the slope of the rim conduit path, in the toilet main unit of a flush toilet according to an embodiment of the invention.

Figure 6:
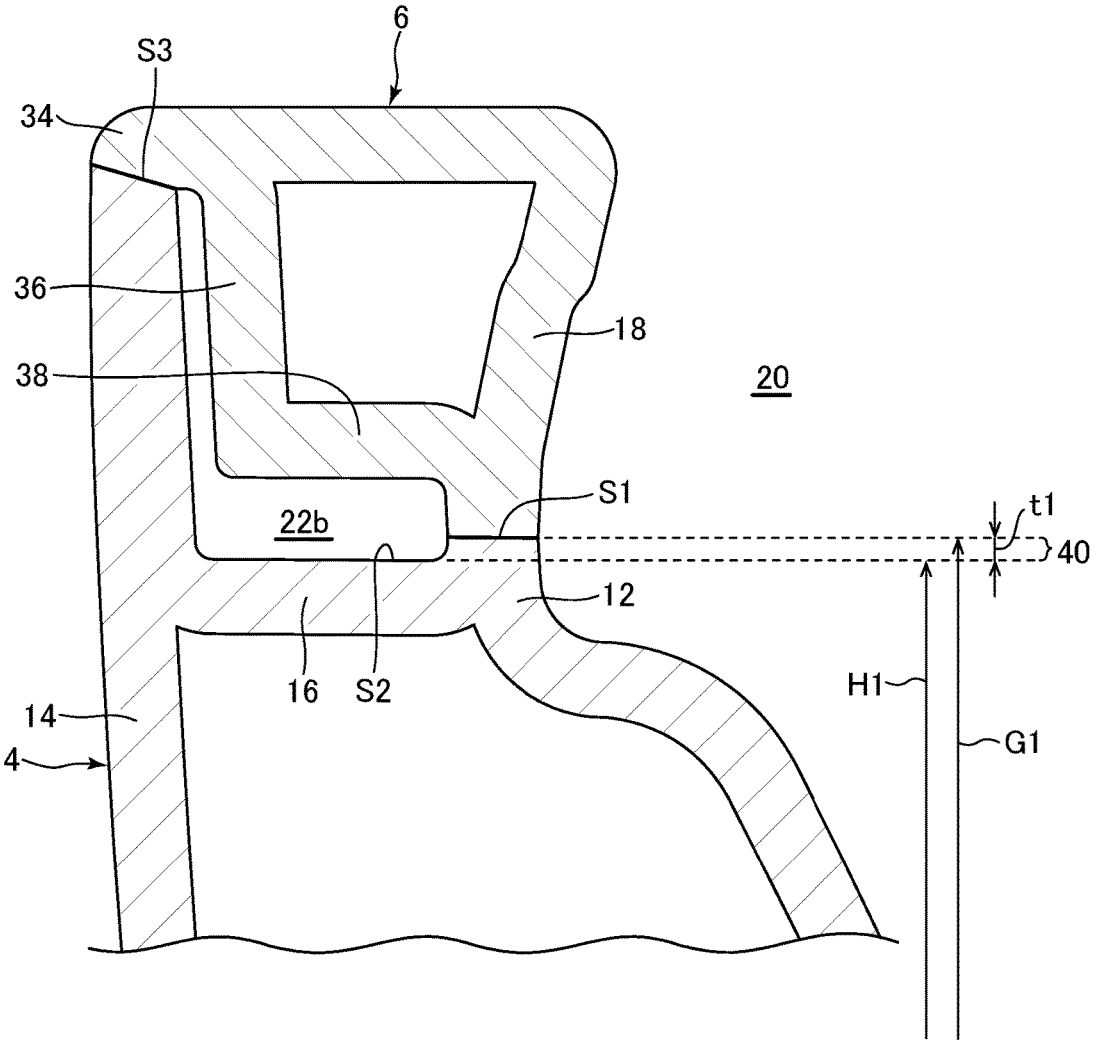
FIG. 6 is a cross section taken along line VI-VI in FIG. 2.
Figure 7:
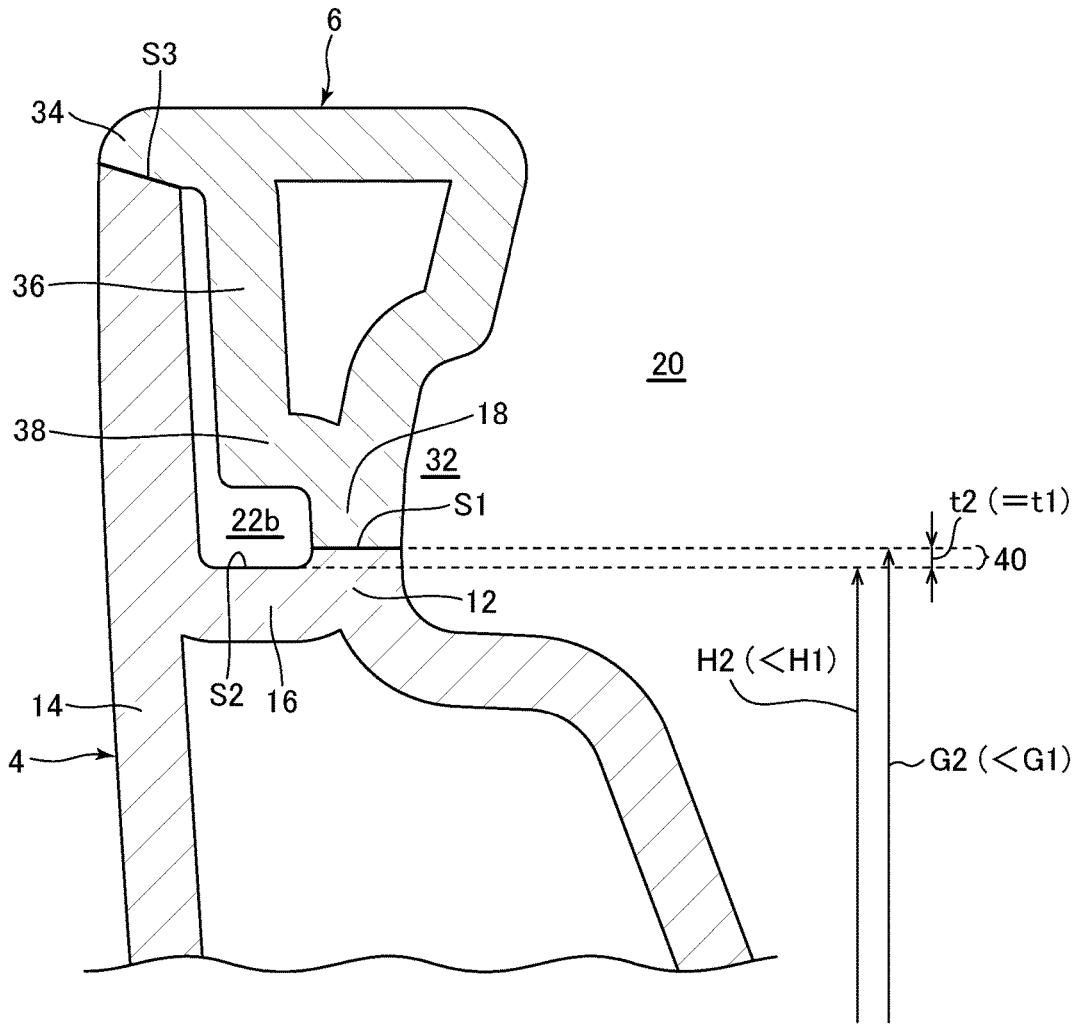
FIG. 7 is a cross section taken along line VII-VII in FIG. 2.
Figure 8:
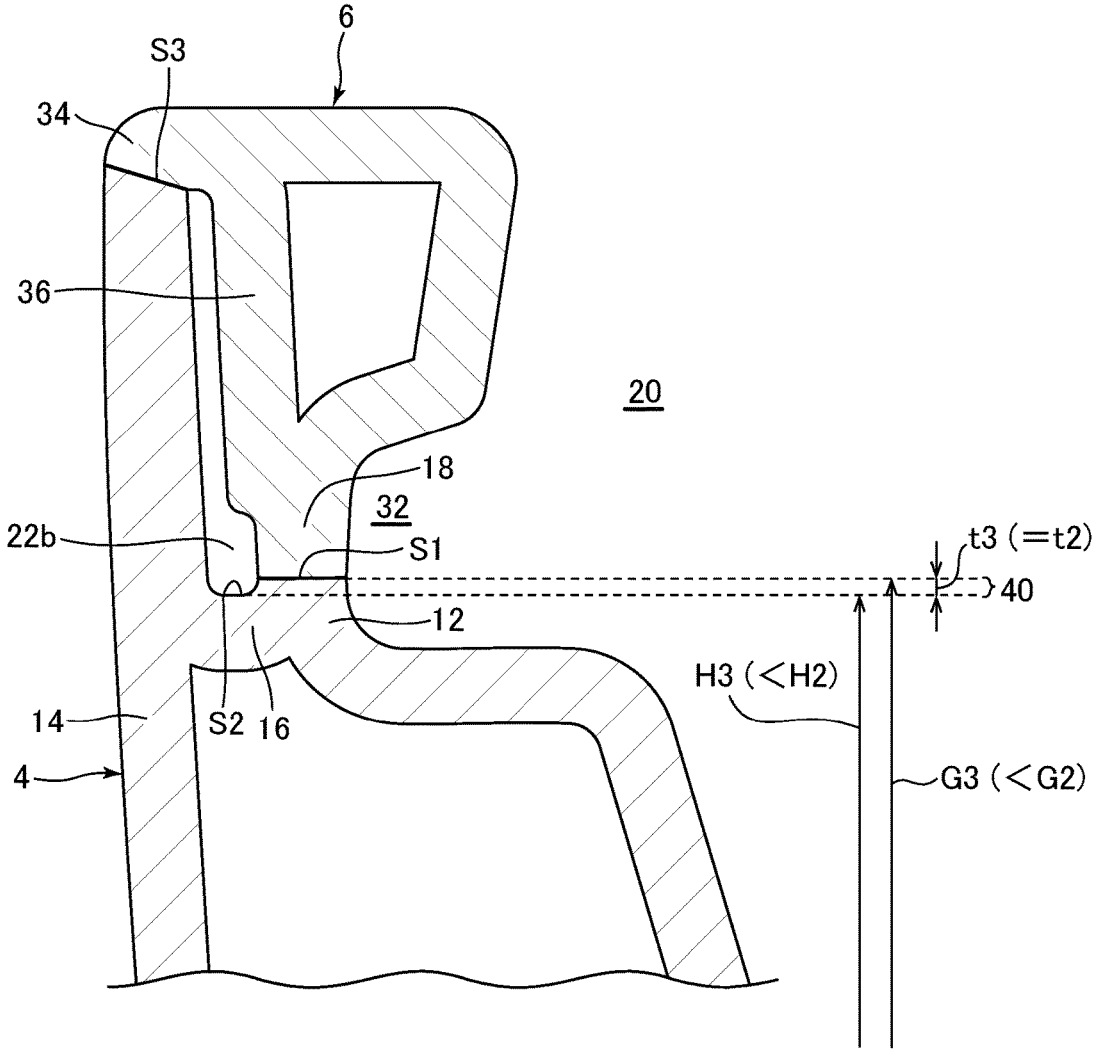
FIG. 8 is a cross section taken along line VIII-VIII in FIG. 2.
Figure 9:
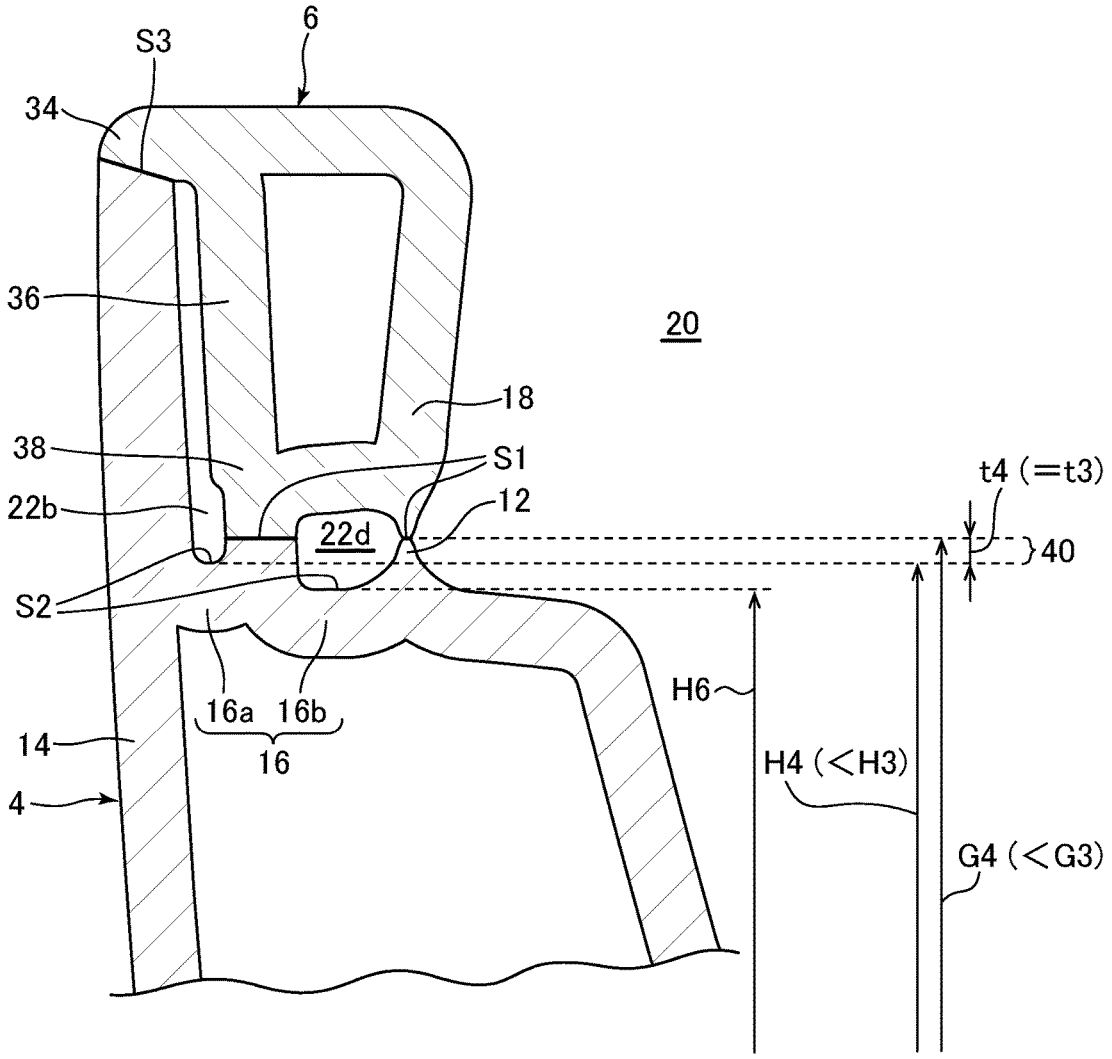
FIG. 9 is a cross section taken along line IX-IX in FIG. 2.

Next, FIG. 6 is a cross section taken along line VI-VI in FIG. 2, and FIG. 7 is a cross section taken along line VII-VII in FIG. 2. FIG. 8 is a cross section taken along line VIII-VIII in FIG. 2. In addition, FIG. 9 is a cross section taken along line IX-IX in FIG. 2.

Figure 10:
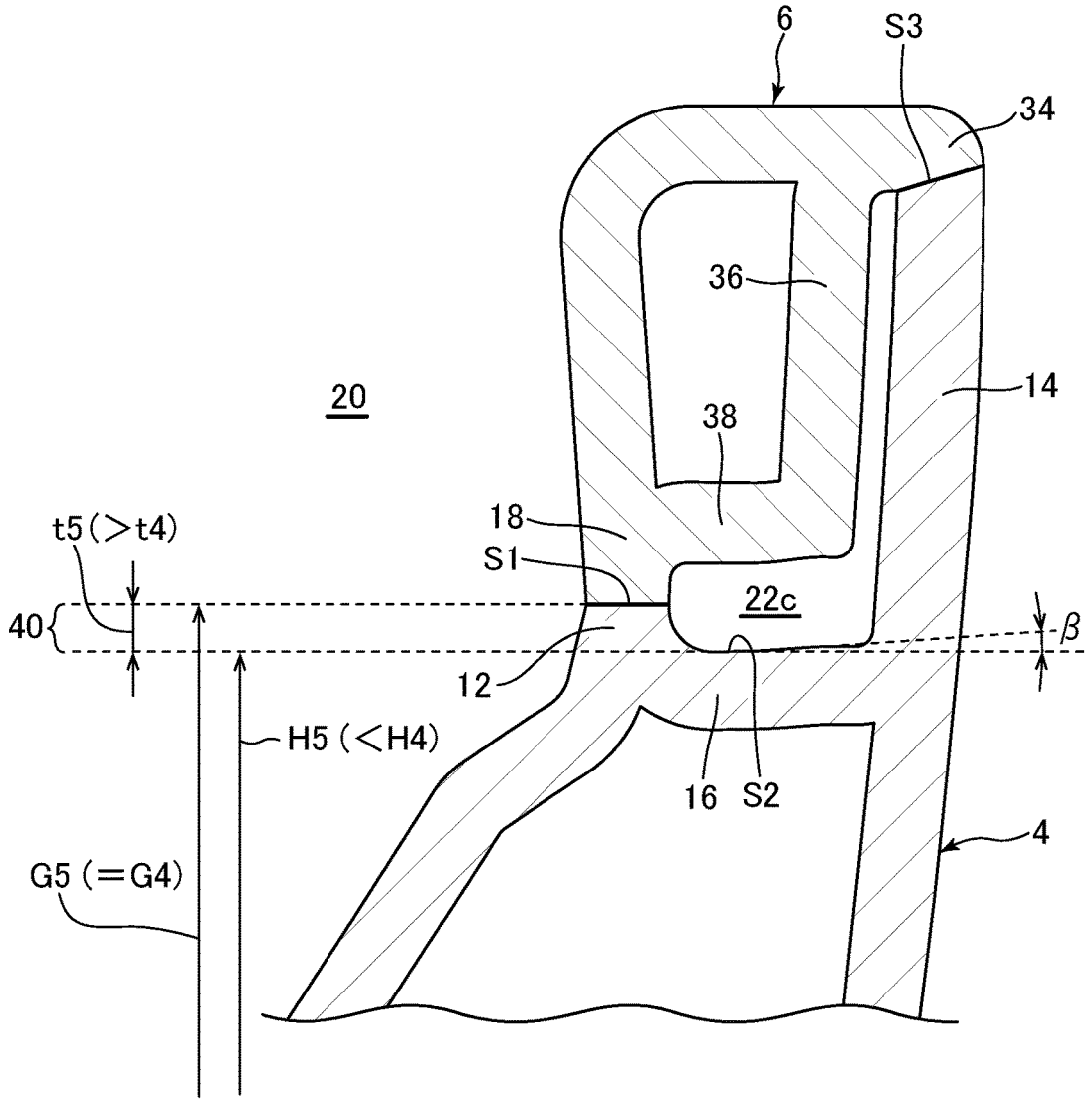
FIG. 10 is a cross section taken along line X-X in FIG. 2.
Figure 11:
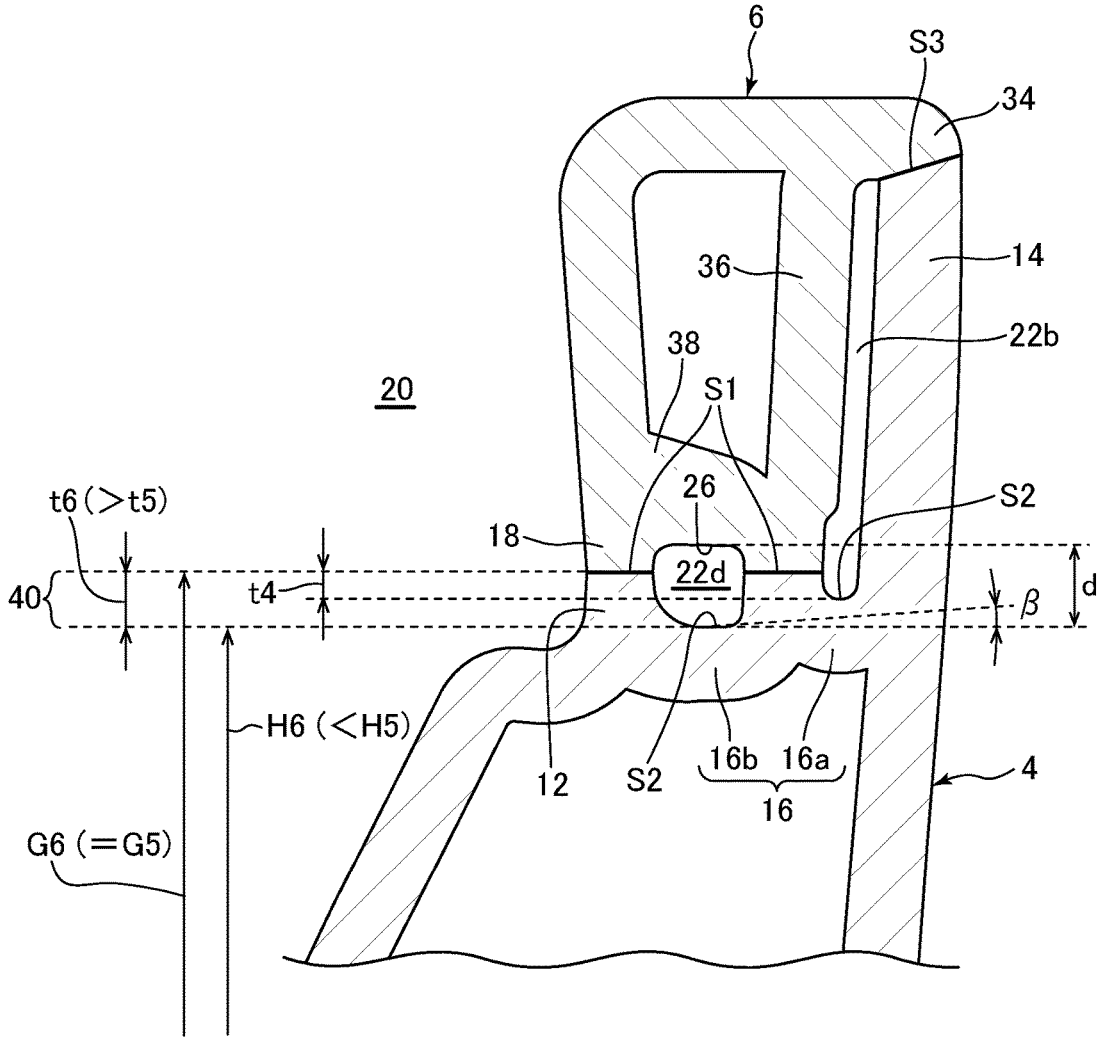
FIG. 11 is a cross section taken along line XI-XI in FIG. 2.
Figure 12:
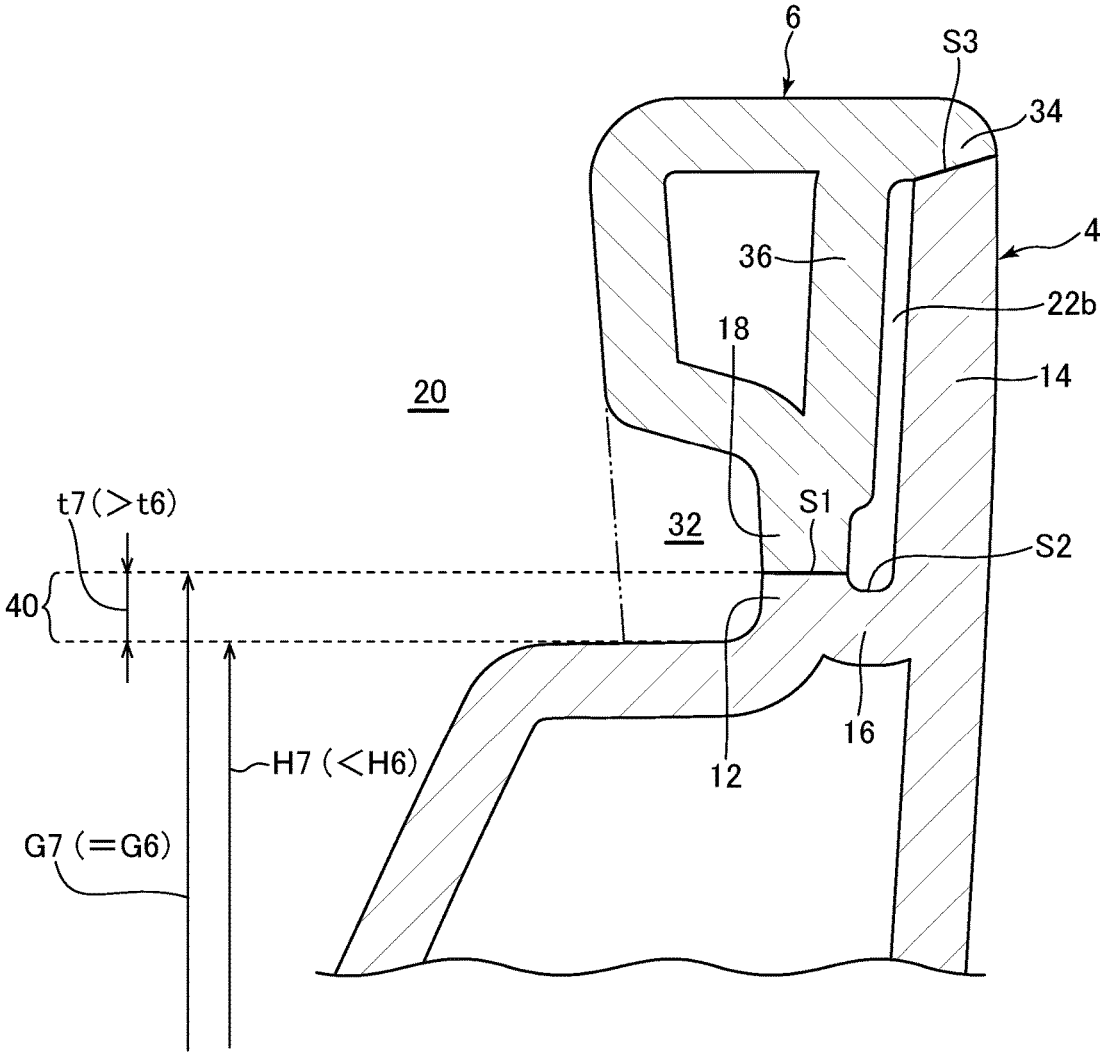
FIG. 12 is a cross section taken along line XII-XII in FIG. 2.

FIG. 10 is a cross section taken along line X-X in FIG. 2. Also, FIG. 11 is a cross section taken along line XI-XI in FIG. 2. FIG. 12 is a cross section taken along line XII-XII in FIG. 2.

First, as shown in FIGS. 4 and 5, the rim conduit 22 includes an inlet 22*a*, an outside rim conduit 22*b*, a bent rim conduit 22*c*, and an inside rim conduit 22*d*. The outside rim conduit 22*b* extends from the inlet 22*a* connected to the water conducting pipe 28, toward the front of the interior of the rim 6. A bent rim conduit 22*c* bends on the inside from the downstream end of this outside rim conduit 22*b*. The inside rim conduit 22*d* extends from the bent rim conduit 22*c* rearward up to the rim spout port 26.

In particular, as shown in FIG. 4, in the section from the rim conduit 22 outside the rim conduit 22*b* through the bent rim conduit 22*c* to the inside rim conduit 22*d* as seen in plan view, the shape bends in a U-shape ("U-turn shape").

Also, as shown in FIGS. 1-4, a conduit 32, which also functions as part of the rim spout portion, is formed on the downstream side of the rim spout port 26.

Additionally, in the toilet main unit 2 shown in FIG. 5, the joining surface S1 between the inner wall 12 of the body 4 and the inner wall 18 of the rim 6 is shown by a solid line. Also, the trajectory described by the bottom surface S2 of the rim conduit 22 from the inlet 22*a* of the rim conduit 22 through the outside rim conduit 22*b*, the bent rim conduit 22*c*, and the inside rim conduit 22*d* to the rim spout port 26 is schematically shown by a dotted line.

Next, as shown in FIGS. 4-12, the joining surface S1 mutually joining the inner wall 12 of the body 4 and the inner wall 18 of the rim 6 forming the rim conduit 22 is set at a low position facing from the rear to the front side of the bowl 20 (see especially FIG. 5).

The bottom surface S2 of the outside rim conduit 22*b*, as shown in FIGS. 6-8, forms the top surface of the connecting portion 16 connecting the inner wall 12 and the outside wall 14 of the body 4. Or, as shown in FIGS. 9 and 11, the bottom surface S2 of the outside rim conduit 22*b* forms the top surface of the outside connecting portion 16*a* of the connecting portion 16 connecting the inner wall 12 and the outside wall 14 of the body 4.

In addition, the bottom surface S2 of the bent rim conduit 22*c*, as shown in FIG. 10, forms the top surface of the connecting portion 16 connecting the inner wall 12 of the body 4 and outside wall 14. The bottom surface S2 of the inside rim conduit 22*d*, as shown in FIGS. 9 and 11, forms the top surface of the inside connecting portion 16*b* in the connecting portion 16 connecting the inner wall 12 of the body 4 and connecting portion 16.

The rim conduit 22 parts 22*a*-22*d* and the bottom surface S2 of the rim spout port 26 are placed so as to face from the upstream end (inlet 22*a*) toward the downstream end (rim spout port 26) of the rim conduit 22, and at a low position. Thus, notwithstanding that the overall pathway of the rim conduit 22 is prone to become a relatively long pathway from the inlet 22*a* through the outside rim conduit 22*b*, the bent rim conduit 22*c*, and the inside rim conduit 22*d* up to the rim spout port 26, the entire bottom surface S2 of the rim conduit 22 is greatly downwardly sloped along the flow path from the inlet 22*a* of the rim conduit 22 to the rim spout port 26.

I.e., as shown in FIG. 5, in the entire segment from the inlet 22*a* of the rim conduit 22 to the rim spout port 26, in the flow path direction from the upstream side toward the downstream side, the bottom surface S2 of the rim conduit 22 as seen in elevation is sloped at a descending slope angle $\alpha$ relative to a horizontal plane.

Note that for a slope angle $\alpha$ of the bottom surface S2 of the rim conduit 22, a setting of, for example, 1° or greater is preferable, and a setting of 3° or greater is most preferable.

Next, as shown in FIGS. 6-12, the joining surface S3 between the top end of the outside wall 14 of the body 4 and the upper wall 34 of the rim 6 is positioned above the joining surface S1 between the top end of the inner wall 12 of the body 4 and the bottom end of the inner wall 18 of the rim 6. With the body 4 and rim 6 mutually joined by the joining surfaces S1 and S3, the outside rim conduit 22*b* is formed by being surrounded by the inner wall 18 of the rim 6, the bottom surface 36, the connecting portion 38 connecting this bottom surface 36 to the inner wall 18, and the upper wall 34, as well as the inner wall 12 of the body 4, the outside wall 14, and the connecting portion 16.

As shown in FIGS. 6-9, the respective position heights of the bottom surface S2 of the outside rim conduit 22*b* are H1-H4. As shown in FIG. 10, the position height of the bottom surface S2 of the bent rim conduit 22*c* is H5. Additionally, as shown in FIG. 11, the position height of the bottom surface S2 of the rim spout port 26 is H6. As shown in FIG. 12, the position height of the conduit 32 at the downstream side of the rim spout port 26 is H7. At this point, in the flow path direction from the upstream side toward the downstream side over the entire segment from the inlet 22*a* of the rim conduit 22 to the rim spout port 26, the bottom surface S2 of the rim conduit 22 is sloped at a descending slope angle $\alpha$ relative to a horizontal plane. Therefore the position heights of the bent rim conduit 22*c* bottom surface S2 decline from the height H1 shown in FIG. 6, through the heights H2-H6 shown in FIGS. 7-11, up to the height H7 shown in FIG. 12 (H1>H2>H3>H4>H5>H6>H7).

Meanwhile, as shown in FIGS. 6-12, the respective position heights of the joining surface S1 between the inner wall 12 of the body 4 and the inner wall 18 of the rim 6 are G1-G7. At this point, the position heights of the joining surface S1 decline gradually, from the height G1 shown in FIG. 6, through the heights G2, G3 respectively shown in FIGS. 7 and 8, to the height G4 shown in FIG. 9 (G1>G2>G3>G4). The heights G5, G6, and G7 respectively shown in FIGS. 10-12 are the same as the height G4 shown in FIG. 9 (G4=G5=G6=G7).

Additionally, as shown in FIGS. 6-9, in the inner wall 12 of the body 4 the heights of the foot portion 40 projecting upward from the height position of the bottom surface S2 of the rim conduit 22 to the joining surface S1 are respectively t1-t4. As shown in FIG. 10, the height of the foot portion 40 projecting upward from the height position of the bottom surface S2 of the bent rim conduit 22*c* to the joining surface S1 is t5. Moreover, as shown in FIG. 11, the height of the foot portion 40 projecting upward from the height position of the rim conduit 22 rim spout port 26 bottom surface S2 to the joining surface S1 is t6. As shown in FIG. 12, the height of the foot portion 40 projecting upward from the height position of the bottom surface S2 of the downstream side conduit 32 of the rim spout port 26 to the joining surface S1 is t7. At this time, the height of the foot portion 40 is the same as the same as from t1 shown in FIG. 6 to t4 shown in FIG. 9 (t1=t2=t3=t4).

However, the height of the foot portion 40*c* gradually increases from t4 shown in FIG. 9 up to heights t5-t7 shown in FIGS. 10-12 (t4<t5<t6<t7).

Note that because positions of the height G3 shown in FIG. 3 and the height G4 shown in FIG. 9 are close to one another, they may also be the same (G3=G4). In such cases, the height t3 shown in FIG. 8 is smaller than the height t4 shown in FIG. 9 (t3<t4).

A reason for making the height of foot portion 40 variable in this way is so that a flow volume within the rim conduit 22 can be secured by the entire rim conduit 22 being formed in a limited space inside the rim 6. Hence the rim conduit 22 reverses in a U-turn from the rim conduit 22 toward the inside rim conduit 22*d* at the bent rim conduit 22*c*, and the entire pathway of the rim conduit 22 can be relatively easily elongated. Therefore along with formulating a measure against residual water in the rim conduit 22, there is also a need to slope the bottom surface S2 of the rim conduit 22 downward from the upstream side toward the downstream side to the greatest extent possible.

Regarding the segment after the rim conduit 22 reverses in a U-turn from the outside rim conduit 22*b* toward the inside rim conduit 22*d* at the bent rim conduit 22*c*, as well, the bottom surface S2 of the rim conduit 22 slopes downward toward the rim spout port 26. By varying the heights t1-t7 of the foot portion 40 from the bottom surface S2 of the rim conduit 22 to the joining surface S1 in response to the position heights H1-H7 of the bottom surface S2 of the rim conduit 22, the entire bottom surface S2 of the rim conduit 22 along the flow path from the upstream end (inlet 22*a*) to the downstream end (rim spout port 26) of the rim conduit 22 can therefore be made to slope downward to the greatest extent possible.

For example, in the present embodiment the heights t1-t4 of the foot portion 40 shown in FIGS. 6-9 are preferably set to 1 mm to 6 mm, for example, and most preferably from 2 mm to 4 mm. In addition, the height t5 of the foot portion 40 shown in FIG. 10 is preferably set from 4 mm to 11 mm, and most preferably from 6 mm to 8 mm.

The height t6 of the foot portion 40 shown in FIG. 11 is preferably set from 5 mm to 12 mm, and most preferably from 7 mm to 9 mm.

In addition, the height t7 of the foot portion 40 shown in FIG. 12 is preferably set from 6 mm to 13 mm, and most preferably from 8 mm to 10 mm.

As shown in FIGS. 4, 10, and 11, in the segment of the inside rim conduit 22*d* after bending at the bent rim conduit 22*c*, the bottom surface S2 of the rim conduit 22 forms a sloped surface sloping downward at a slope angle β relative to a horizontal plane, toward the inside of the bowl 20, as seen in the elevation shown in FIGS. 10 and 11.

Thus residual water in the rim conduit 22 can be efficiently and reliably discharged from the rim spout port 26 while directing [the conduit] to the inside of the bowl 20 along the sloped surface (bottom surface S2) sloped downward at a slope angle β relative to a horizontal plane toward the inside of the bowl 20.

Note that for the slope angle β of the bottom surface S2 of the rim conduit 22, a setting of, for example, 1° to 10° is preferable, and a setting of 2° to 3° is most preferable.

In addition, as discussed above, in the present embodiment the upstream side of the water passageway 28 shown in FIG. 4 is directly connected to a water utility (not shown) serving as flush water source. Flush water is thus supplied from the water conducting pipe 28 into the rim conduit 22 using this water utility supply pressure.

The flow volume of flush water in the rim conduit 22 is thus relatively small, and the flush water source supply pressure can easily exert influence. For this reason, the height d of the rim spout port 26 (see FIG. 11) is set relatively small so as to achieve a sufficient flush water flow speed within the rim conduit 22.

Here the height dimension d of the rim spout port 26 is preferably set from 6 mm to 20 mm, and most preferably is set from 8 mm to 15 mm.

Next the operation of the flush toilet 1 according to the above-described one embodiment of the invention will be explained.

First, using the flush toilet 1 according to the one embodiment of the invention, the joining surface S1 between the inner wall 12 of the body 4 forming the rim conduit 22 and the inner wall 18 of the rim 6 is set at a low position from the rear side toward the front side of the bowl 20. At the same time, the bottom surface S2 of the rim conduit 22 formed by the connecting portion 16 of the body 4 is set to a low position from the upstream end (inlet 22*a*) toward the downstream end (rim spout port 26) of the rim conduit 22. This enables the entire bottom surface S2 of the rim conduit 22 to be tilted greatly downward along the flow path from the top end (inlet 22*a*) to the downstream end of the rim conduit 22.

The discharge force by which residual water in the rim conduit 22 is discharged from the rim spout port 26 can thus be increased.

Next, in the flush toilet 1 according the present embodiment, the rim conduit 22 and the rim spout port 26 are formed on the rim 6 disposed on the front side region F and right side region R of the bowl 20. Also, the rim conduit 22 includes an outside rim conduit 22*b* extending from the inlet 22*a* thereof toward the interior of the rim 6 toward the front, the bent rim conduit 22*c* bending to the inside from the downstream end of this outside rim conduit 22*b*, and the inside rim conduit 22*d* extending from this bent rim conduit 22*c* toward the rear, up to the rim spout port 26. By this means, the bottom surface S2 of the rim conduit 22 is set to a low position from the inlet 22*a* of the rim conduit 22 through the outside rim conduit 22*b*, the bent rim conduit 22*c*, and the inside rim conduit 22*d* toward the rim spout port 26, even if the rim conduit 22 is a relatively easily elongated pathway. Therefore the entire bottom surface S2 of the rim conduit 22 can be sloped greatly downward along the flow path from the inlet 22*a* of the rim conduit 22 to the rim spout port 26.

Hence residual water in the rim conduit 22 can be reliably discharged from the rim spout port 26.

In the flush toilet 1 according to the present embodiment, the bottom surface S2 in the inside rim conduit 22*d* segment after bending at the bent rim conduit 22*c* of the rim conduit 22 forms a sloped surface sloping at the slope angle β toward the inside of the bowl 20. Thus residual water in the rim conduit 22 can be efficiently and reliably discharged from the rim spout port 26 while directing it to the inside of the bowl 20 along the sloped surface (bottom surface S2).

Moreover, with the flush toilet 1 according to the present embodiment, the upstream side of the water conducting pipe 28 shown in FIG. 4 is directly connected to a water utility (not shown) serving as flush water source. Thus flush water is supplied from the water conducting pipe 28 into the rim conduit 22 using this water utility supply pressure.

Therefore since the flow volume of flush water in the rim conduit 22 is relatively small, and the flush water source supply pressure can easily exert influence, a sufficient flow sped in the rim conduit 22 can be fully secured by setting the height dimension d of the rim spout port 26 to be relatively small.

Hence the residual water discharge force in the rim spout port 26 can also be increased.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet configured to discharge waste by flushing the flush toilet with flush water supplied from a flush water source, the flush toilet comprising:

a body which includes a body inner wall forming a majority of a bowl surface, an outer wall forming an external surface, and a connecting portion connecting the outer wall and the body inner wall;

a rim which includes a rim inner wall forming a part of the bowl surface, the rim being joined to a top end of the body;

a bowl formed by joining of the body inner wall and the rim inner wall; and a rim spout portion disposed on the bowl, the rim spout portion configured to spout the flush water inside the bowl;

wherein the rim spout portion includes a rim conduit and a rim spout port, the rim conduit being formed in a closed flow path by joining of the body and the rim and through which the flush water supplied from the flush water source passes, and the rim spout port being at a downstream end of the rim conduit;

a joining surface between the body inner wall and the rim inner wall which form at least the rim conduit continually slopes downward from a rear side toward a front side of the bowl;

the joining surface at a cross section of the rim spout port is positioned at a position lower than a position of the joining surface at an upstream side of the rim conduit with respect to the rim spout port; and a bottom surface in a downstream side of the rim conduit formed by the connecting portion of the body is positioned lower than a bottom surface in the upstream side of the rim conduit.

2. The flush toilet according to claim 1, wherein the bowl includes a front side region and a rear side region, the front side region being formed on a front side of a center axis extending horizontally in a left-right direction of the bowl so as to divide the bowl equally in a front-rear direction of the bowl, the rear side region being formed on a rear side of the center axis; and the rim conduit and the rim spout port are formed on the rim disposed on either a left or right of the front side region of the bowl;

the rim conduit includes an inlet, an outside rim conduit, a bent rim conduit, and an inside rim conduit; the outside rim conduit being configured to extend forward from the inlet through an interior of the rim; the bent rim conduit being configured to bend to an inside from a downstream end of the outside rim conduit; and the inside rim conduit being configured to extend rearward from the bent rim conduit up to the rim spout port; and the bottom surface of the rim conduit continually slopes downward from the inlet through the outside rim conduit, the bent rim conduit and the inside rim conduit, toward the rim spout port.

3. The flush toilet according to claim 2, wherein a bottom surface of the inside rim conduit is sloped downward toward an inside of the bowl.

4. The flush toilet according to claim 1, wherein the flush water source is a utility water pipe configured to supply flush water to the rim conduit by using water utility supply pressure.

* * * * *